US008684570B1

(12) United States Patent
Fuchs

(10) Patent No.: US 8,684,570 B1
(45) Date of Patent: Apr. 1, 2014

(54) LIGHT FIXTURE WITH MOVABLE SUPPORT FOR A REMOVABLE ELECTRONIC COMPONENT

(75) Inventor: Patrick Fuchs, Hyde Park, NY (US)

(73) Assignee: USAI, LLC, New Windsor, NY (US)

( * ) Notice: Subject to any disclaimer, the term of this patent is extended or adjusted under 35 U.S.C. 154(b) by 335 days.

(21) Appl. No.: 12/964,440

(22) Filed: Dec. 9, 2010

Related U.S. Application Data

(60) Provisional application No. 61/285,078, filed on Dec. 9, 2009.

(51) Int. Cl.
*F21S 8/08* (2006.01)

(52) U.S. Cl.
USPC ..... 362/418

(58) Field of Classification Search
USPC ..... 362/418
See application file for complete search history.

(56) References Cited

U.S. PATENT DOCUMENTS

2001/0022301 A1* 9/2001 O'Donnell ..... 220/3.92
2011/0103062 A1* 5/2011 Park et al. ..... 362/282

* cited by examiner

*Primary Examiner* — Anh Mai
*Assistant Examiner* — Hana Featherly
(74) *Attorney, Agent, or Firm* — St. Onge Steward Johnston & Reens LLC

(57) ABSTRACT

A light fixture includes an illumination aperture and a normal illumination axis passing through a center of the illumination aperture perpendicular to a plane of the illumination aperture. The light fixture further includes a service space having a cross-section corresponding to a shape of the illumination aperture and extending along the illumination axis between on a support structure facing side of the illumination aperture. The light fixture has a movable support movably coupled to the light fixture. The movable support includes a mounting portion. An electronic component is removably mounted to the mounting portion. The movable support is movable between an operation position and a service position. When the movable support is in the service position, the mounting portion and electronic component are closer to the illumination axis than when in the operation position, and are preferably located wholly or partially within service space.

18 Claims, 16 Drawing Sheets

LIGHT FIXTURE WITH MOVABLE SUPPORT FOR A REMOVABLE ELECTRONIC COMPONENT

CROSS-REFERENCE TO RELATED APPLICATIONS

The present application claims the benefit under 35 U.S.C. §119(e) of the U.S. Provisional Patent Application Ser. No. 61/285,078, filed on Dec. 9, 2009, the content of which is incorporated herein by reference.

FIELD OF THE INVENTION

The apparatus described herein is generally directed to the field of light fixtures and, in particular, to recessed lighting fixtures.

BACKGROUND OF THE INVENTION

Light fixtures, such as recessed light fixtures, typically include an enclosure which houses a lighting element (the light) and other electronic components, such as a ballast, a transformer, a driver or other components. The light is located in or above (or is aligned with) an illumination aperture formed in the enclosure, such as on the bottom wall. Other electronic components are disposed within the enclosure, such as adjacent or affixed to one of the side walls. The electronic components are affixed to the enclosure with mounting fasteners and are connected to other electronic components by electrical connections.

Removal and replacement of electronic components of recessed lighting fixture may be required if, for example, a component fails or otherwise needs to be replaced. However, the illumination aperture often provides the only means to access the interior of the enclosure after the lighting fixture has been installed in a structure such as a room ceiling or wall. Illumination apertures are typically about 3-5 inches in diameter, which only permits a user to insert one hand into the enclosure. Furthermore, enclosures can have side wall spaced much further apart than the diameter of the illumination aperture, for example about 12-14 inches apart (or more) and the enclosures are typically dark, with no means to look inside the enclosure once a hand is inserted in the aperture.

Thus, with such prior lighting fixtures, a person attempting to remove and replace a component mounted on or adjacent one of the walls of the enclosure must extend their hand into the aperture, and then blindly reach for the desired component. After finding the component (by feel), the person must then detach the mounting fasteners and disconnect the electrical connections (again by feel). Often, such procedure requires the person to hold their hand/wrist in an awkward and uncomfortable position. Thus, with prior lighting fixtures, the removal and replacement of electronic components can be difficult and time consuming.

Therefore, what is desired is a device and method to improve the process of removing and replacing electronic components within an enclosure of a recessed lighting fixture. The lighting fixture disclosed herein accomplishes that goal.

SUMMARY OF THE INVENTION

A light fixture includes an illumination aperture having a room-facing side and a support structure facing side opposite the room-facing side. An illumination axis passes through a center of the illumination aperture perpendicular to a plane of the illumination aperture. The light fixture has service space on the support structure facing side of the aperture which has a cross-section corresponding to a shape of the illumination aperture and which extends along the illumination axis from the illumination aperture. The light fixture has a movable support movably coupled to the light fixture and an electronic component removably mounted to the movable support. The movable support has an operation position wherein the electronic component is located outside of the service space and has a service position wherein the electronic component is substantially closer to the illumination axis than when in the operation position and/or the electronic component is wholly or partially within the service space when in the service position, to provide for convenient and efficient removal and replacement of the electronic component.

Additionally or alternatively, the light fixture includes an enclosure with a front wall and a back wall opposite to the front wall and an illumination aperture. The extends along the illumination axis between the illumination aperture and the back wall of the enclosure. The movable support is movably coupled to the enclosure and includes a mounting portion that removably mounts an electronic component. The movable support is movable between an operation position and a service position. The mounting portion and/or electronic component are located outside the service space when the movable support is in the operation position, and the mounting portion and/or electronic component are substantially closer to the illumination axis and/or wholly or partially within the service space when the movable support is in the service position to provide ready access to the electronic component.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
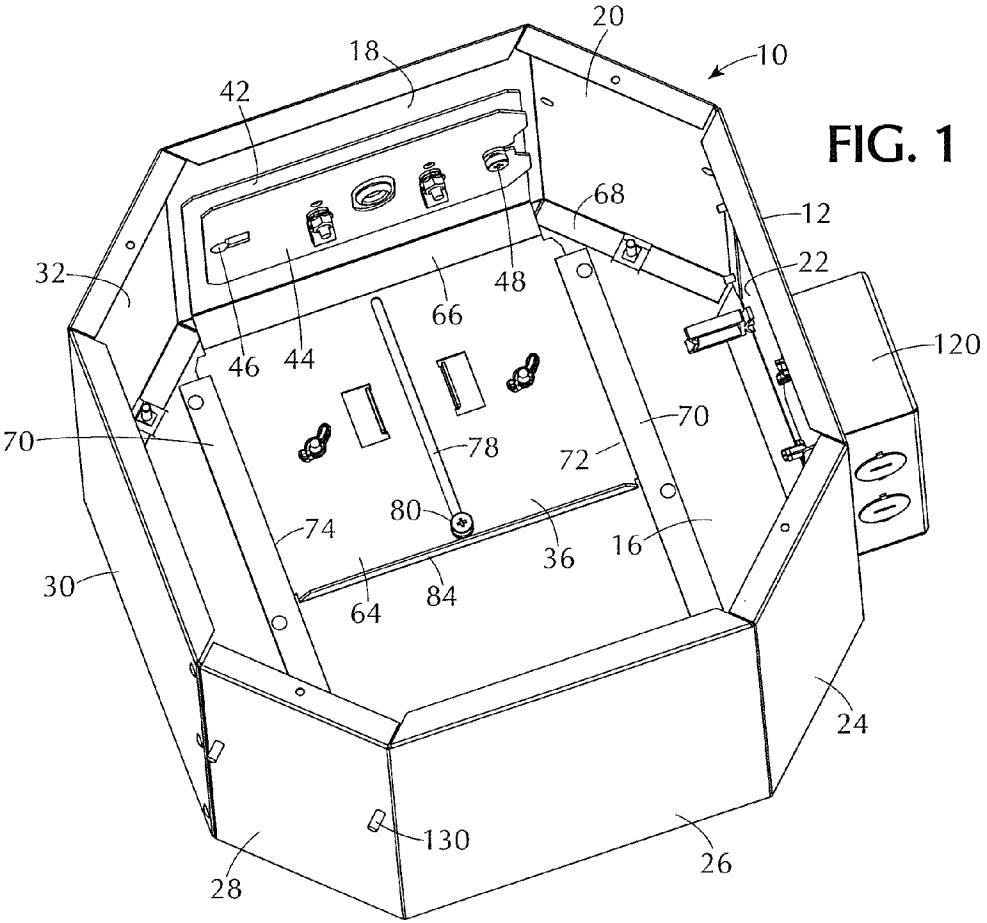
FIG. 1 is a perspective view of one embodiment of the lighting fixture with the front wall removed and the movable support in the operation position.
Figure 2:
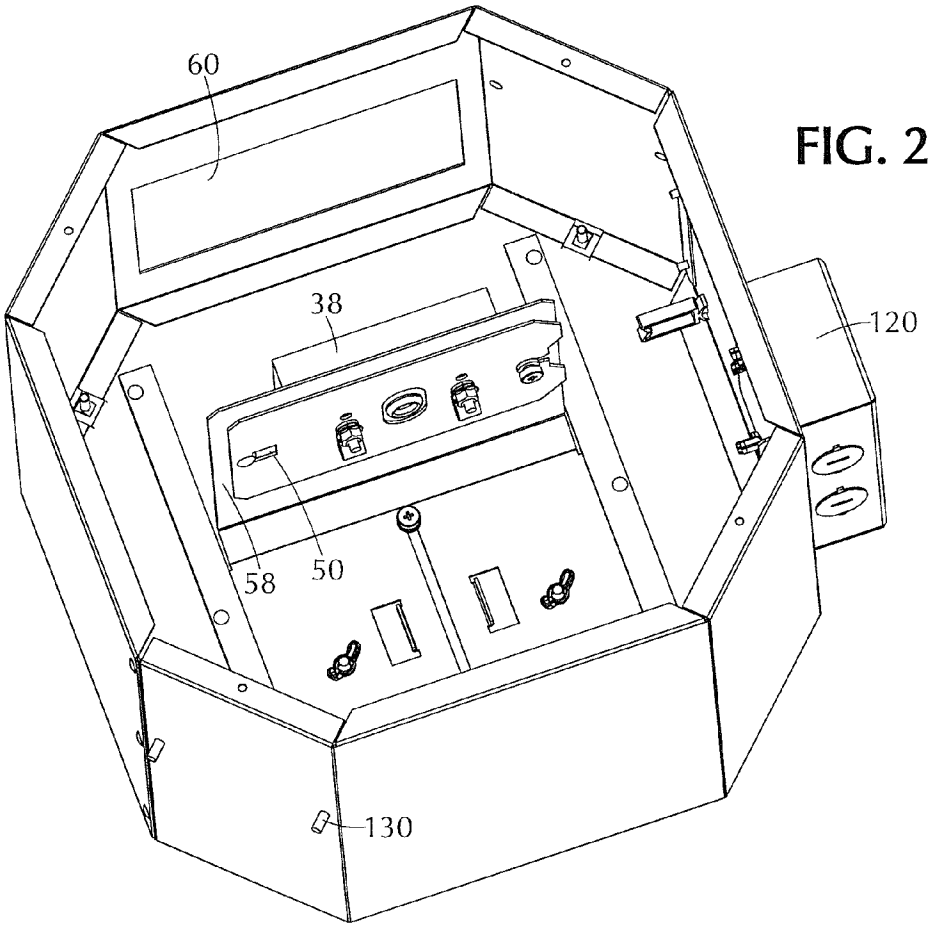
FIG. 2 is a perspective view of the embodiment of FIG. 1 with the front wall removed and the movable support in the service position.
Figure 3:
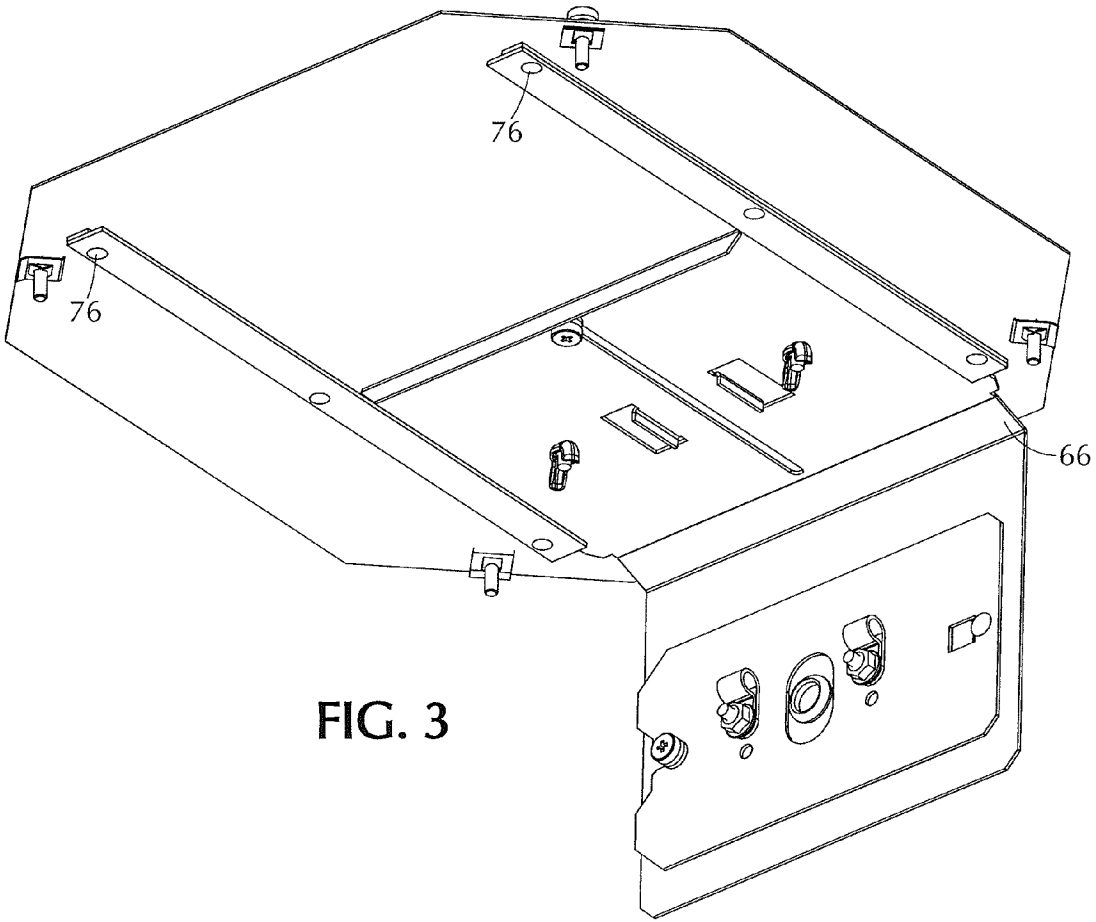
FIG. 3 is a perspective view of the back wall and movable support according to the embodiment of FIG. 1 in the operation position.
Figure 4:
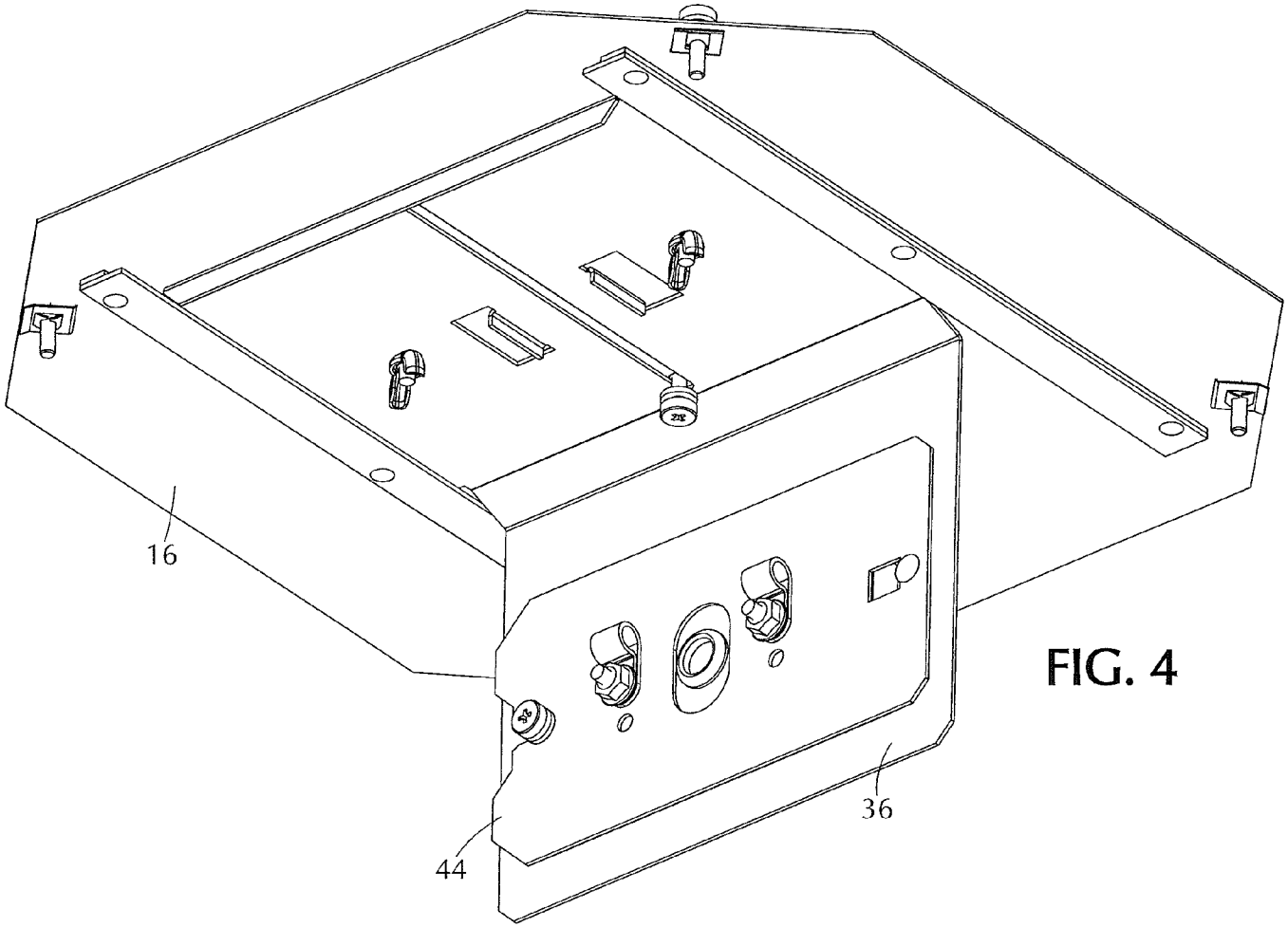
FIG. 4 is a perspective view of the back wall and movable support according to the embodiment of FIG. 1 in the service position.
Figure 5:
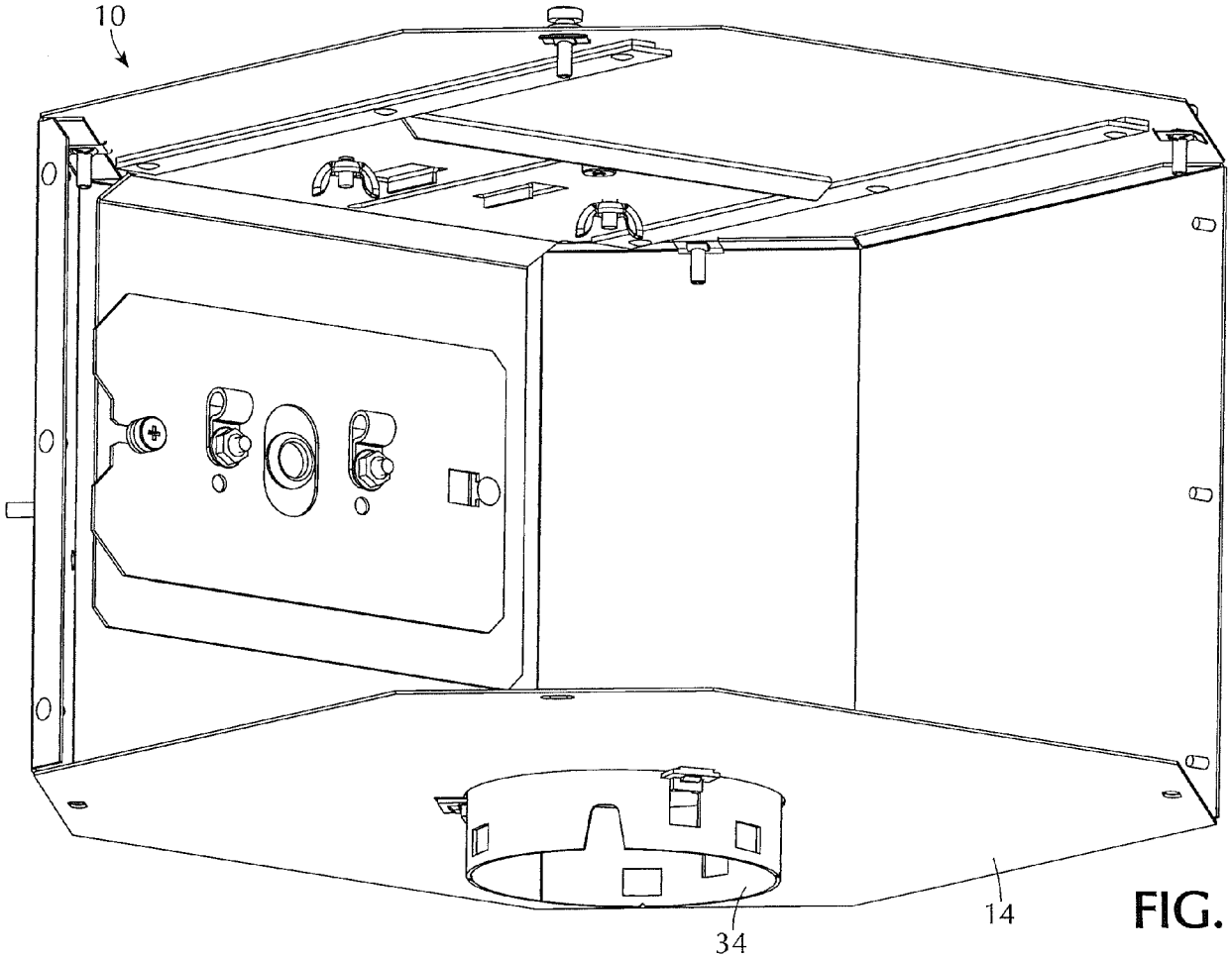
FIG. 5 is a cutaway side view of the embodiment of FIG. 1 with the movable support in the operation position.
Figure 6:
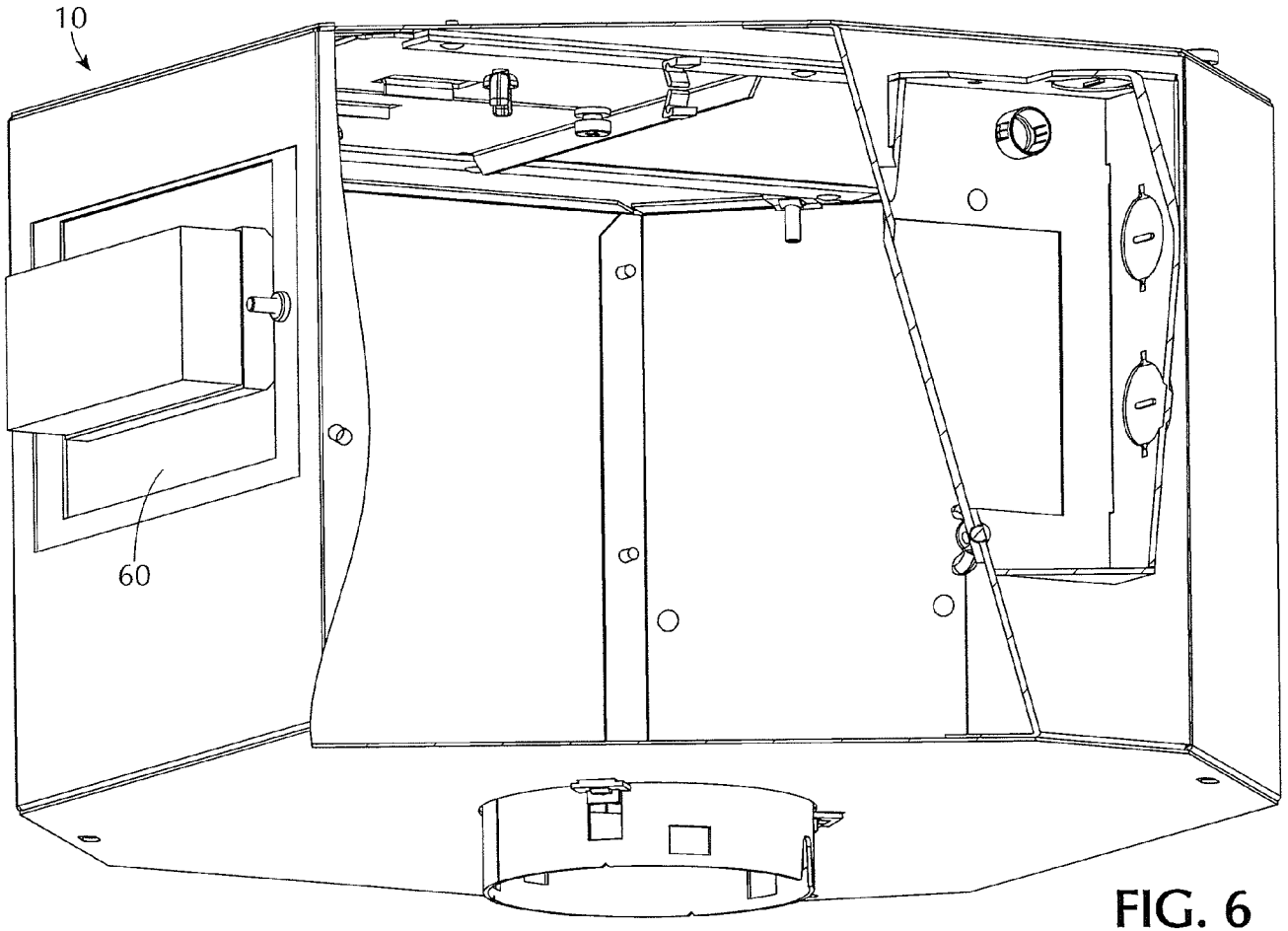
FIG. 6 is a cutaway side view of the embodiment of FIG. 1 with the movable support in the operation position.
Figure 7:
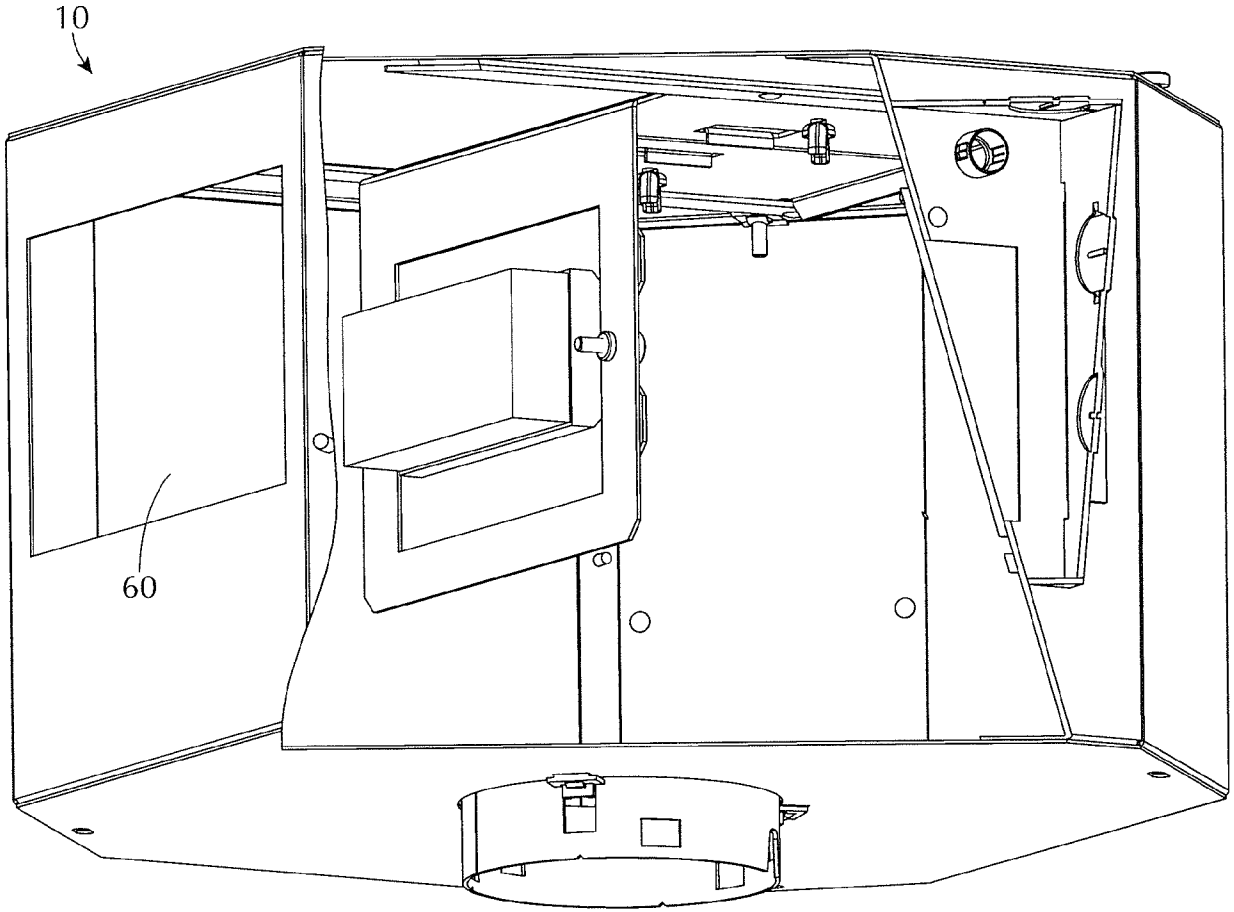
FIG. 7 is a cutaway side view of the embodiment of FIG. 1 with the movable support in the service position.
Figure 8:
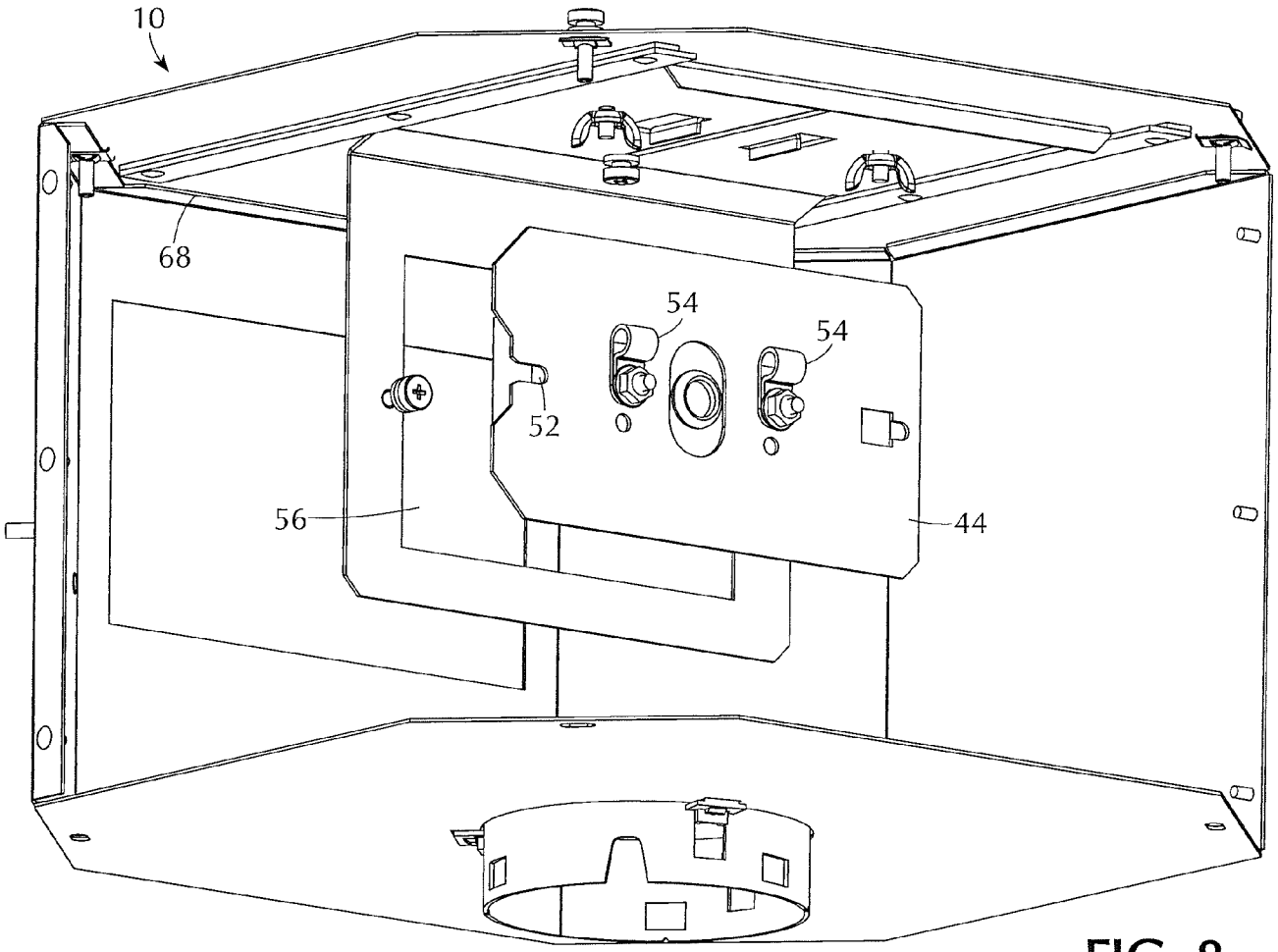
FIG. 8 is a cutaway side view of the embodiment of FIG. 1 with the movable support in the service position with the base plate removed from the mounting portion.
Figure 9:
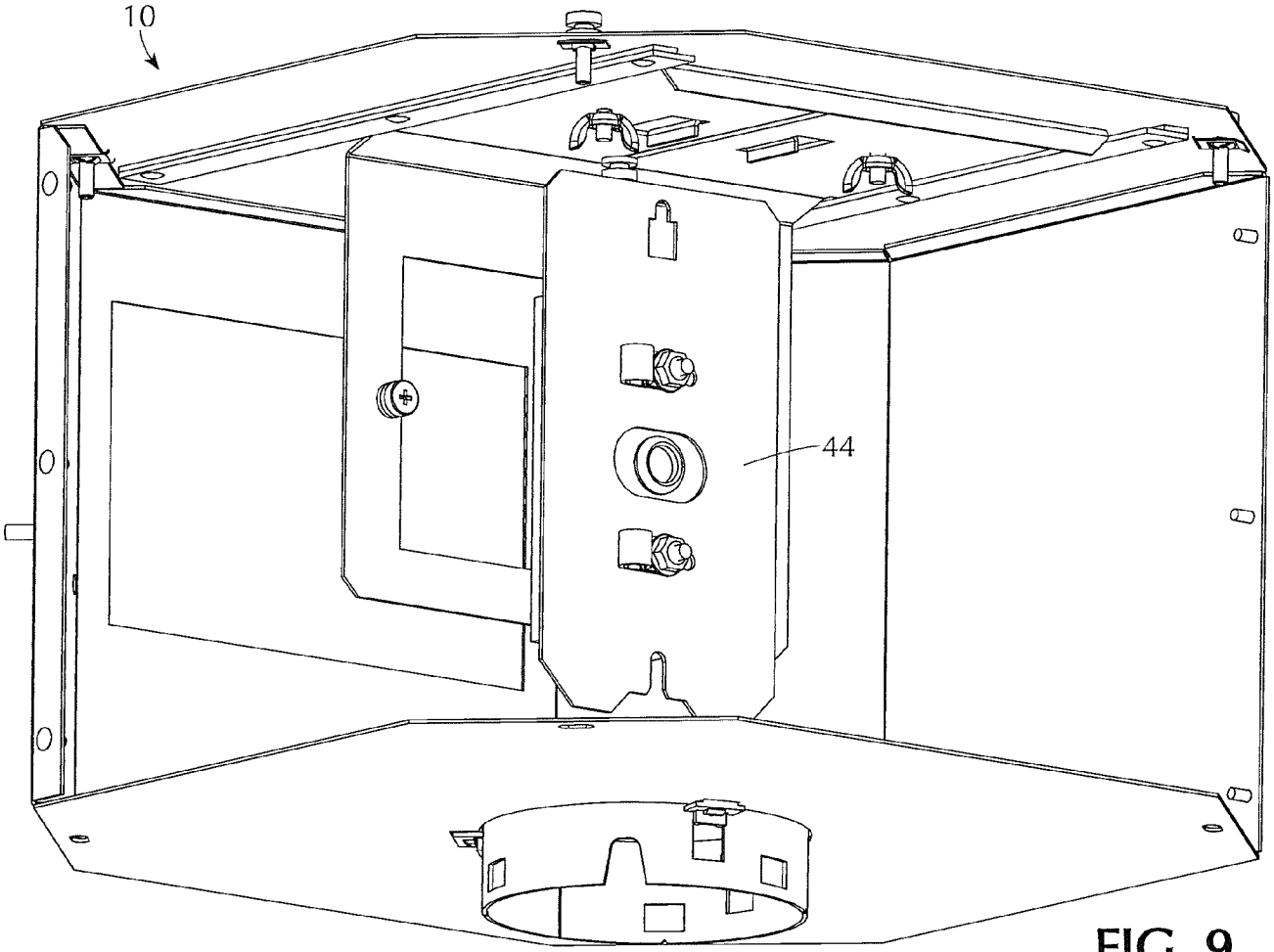
FIG. 9 is a cutaway side view of the embodiment of FIG. 1 with the movable support in the service position with the electronic component oriented in a position for removal from the enclosure.
Figure 10:
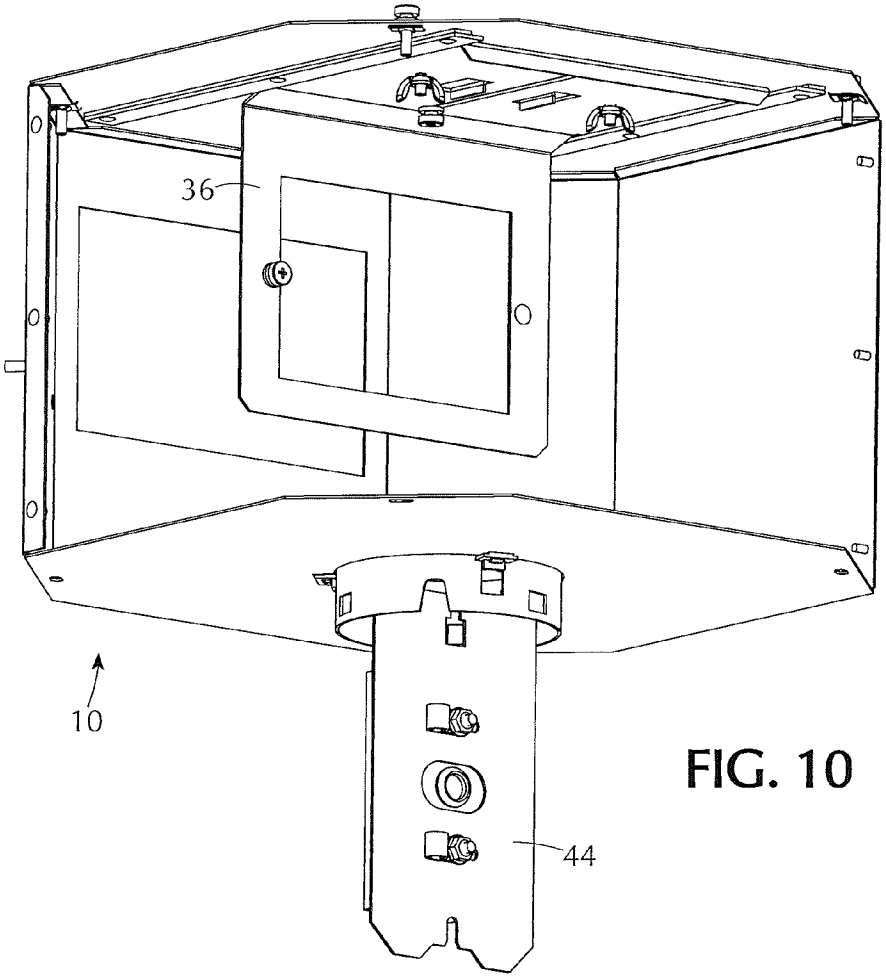
FIG. 10 is a cutaway side view of the embodiment of FIG. 1 with the movable support in the service position with the electronic component removed from the enclosure.
Figure 11:
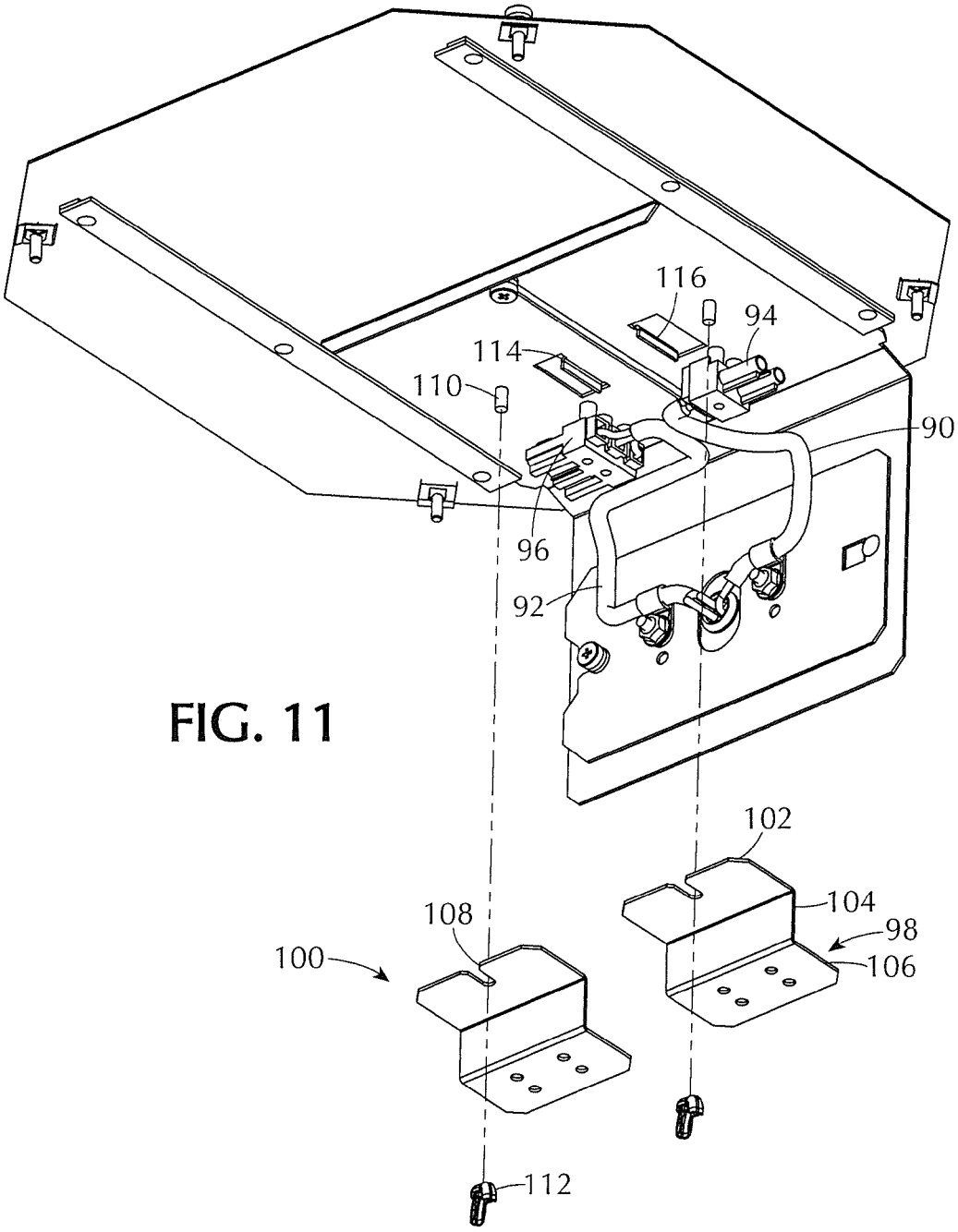
FIG. 11 is a perspective view of the back wall and movable support according to the embodiment of FIG. 1 in the operation position.
Figure 12:
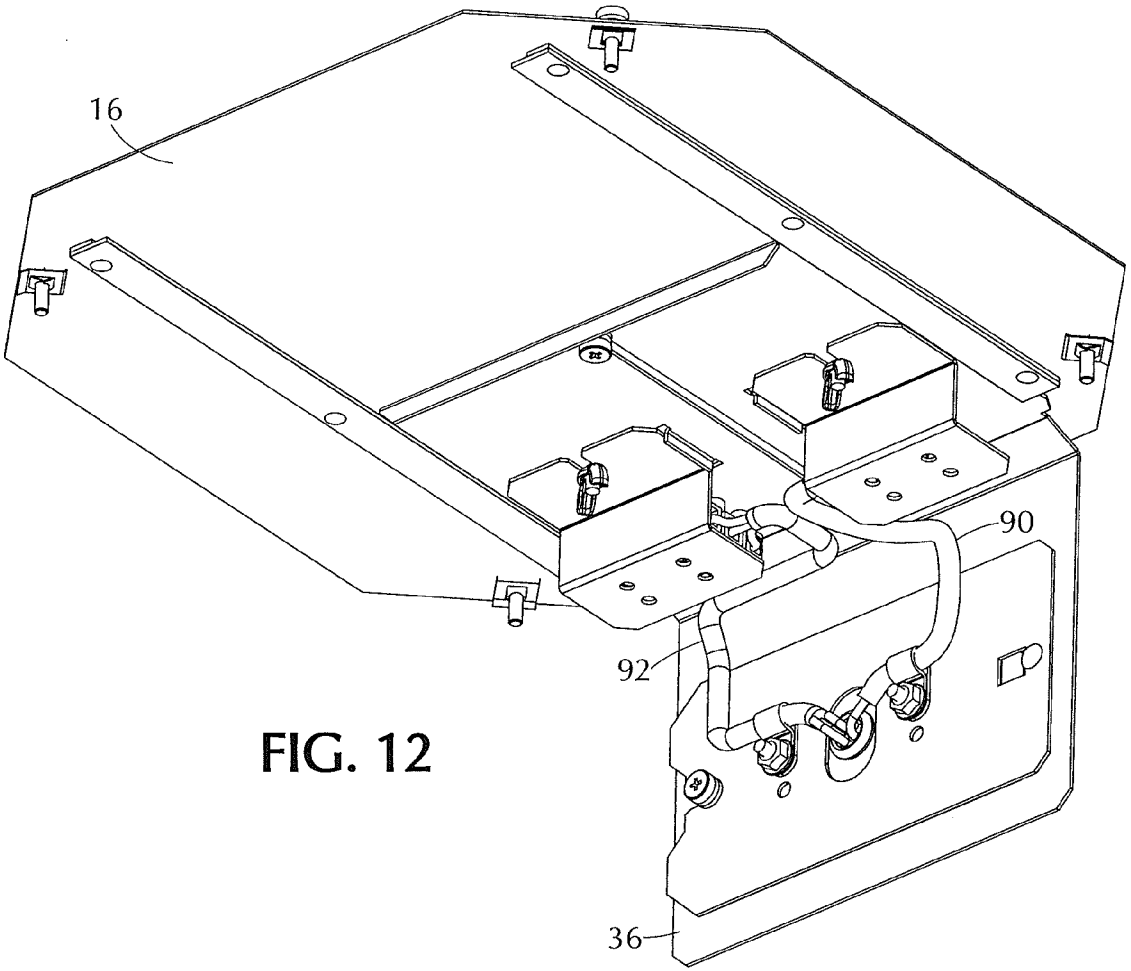
FIG. 12 is a perspective view of the back wall and movable support according to the embodiment of FIG. 1 in the operation position.
Figure 13:
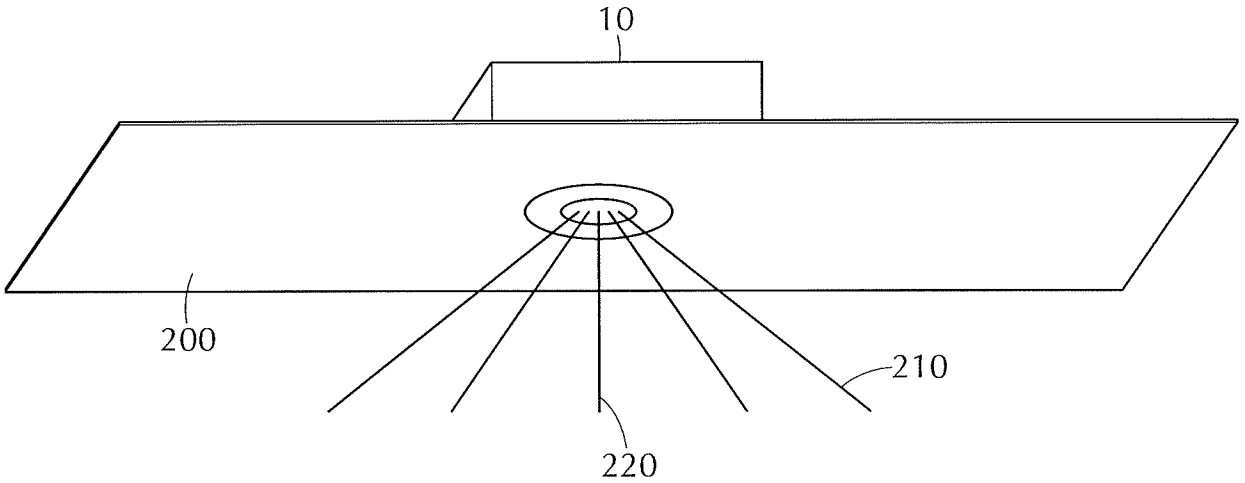
FIG. 13 is a perspective view of an embodiment of the light fixture installed in a ceiling.

FIG. 13 is a perspective view of an embodiment of the recessed light fixture 10 installed in a ceiling 200. Typically, ceiling 200 will be composed of sheet rock or some other sturdy, permanently installed substrate. The light fixture 10 is disposed above the ceiling 200, and may be mounted to a support structure in a position adjacent to the upper surface of the ceiling 200. The ceiling 200 comprises a hole which is of a size and shape that corresponds to a shape of the illumination aperture 34 of the light fixture 10. When installed, light fixture 10 is arranged such that lighting element (not shown) within lighting fixture 10 shines through the illumination aperture 34 to illuminate the area bellow ceiling 200 with light emissions 210. The lighting fixture 10 has a normal illumination axis 220 which passes through a center of the illumination aperture 34 and is perpendicular to a plane 240 of the illumination aperture 34.

After installation of the light fixture 10 in the ceiling 200 and after final construction is completed (e.g. plaster and painting), the hole and illumination aperture 34 are often the only means of accessing the interior of light fixture 10 to service the light fixture 10 and the components therein. Thus, the illumination aperture 34 is sized and shaped to permit installation and removal of the light element and other components therethrough.

Referring to FIGS. 1-14, the lighting fixture 10 has an enclosure 12 that can be formed from sheet metal. The enclosure 12 has a front wall 14, a back wall 16 and a number of side walls 18, 20, 22, 24, 26, 28, 30, 32. The illumination aperture 34 may have a circular (round) shape and is disposed on the front wall 14 of the enclosure 12. The enclosure houses the lighting element and houses and/or provides a mounting support for other electronic components, such as a ballast, a driver, a transformer or other electronic components. The electronic components are connected directly to a power source or indirectly through a power supply electronic component, such as a transformer. Light fixture 10 includes electrical coupler 120 that connects the circuitry in light fixture 10 to an electrical source such as a 120VAC power line. Light fixture 10 also includes exterior mounts 130 on its exterior walls. This permits light fixture 10 to be secured by support hardware when installed above ceiling 200.

The lighting fixture 10 includes a movable support 36 for an electronic component 38 which movable support has an operation position and a service position. The movable support preferably has a mounting portion 42 that is operable to support the electronic component 38 mounted thereon.

FIGS. 1, 3, 5, 6, 11, and 12 depict the movable support in the operation position.

FIGS. 2, 4, 7, 9, and 10 depict the movable support in the service position.

Preferably, in the operation position, the mounting portion 42 and/or electronic component 38 mounted to the movable support are located adjacent to or in contact with (or closely abutting) one of the side walls 18 of the enclosure 12. When the movable support is in the operation position, the mounting portion 42 and/or the electronic component 38 are preferably spaced from the illumination axis 220 a distance equal to or greater than one and one-half (1½) times, or greater than two (2) times, a diameter or a width of the illumination aperture 34.

The movable support 36 includes a support portion 64 which is substantially planar and is preferably aligned substantially perpendicular to the mounting portion 42. The support portion 64 can be connected to the mounting portion 42 by a chamfered or inclined intermediate portion 66 aligned at an angle of greater than ninety degrees with respect to the mounting and support portions. The purpose of the inclined intermediate portion 66 is to provide clearance for an overlap 68 of the panels forming the walls of the enclosure 12 along the intersection of the side wall 18 and top wall such that the mounting portion 42 can abut the side wall 18 when the movable support 36 is in the operation position.

The support portion 64 is movably attached to the enclosure 12 such that the movable support 36 can move between the operation position and the service position while remaining slidably attached to or supported by the enclosure 12. As depicted, the support portion 64 can be slidably attached to the enclosure 12 via a pair of guides or rails 70 formed in or attached to the back wall 16 of the enclosure 12 opposed to the front wall 14 having the illumination aperture 34. The guides 70 slidably engage and support opposed edges 72, 74 of the support portion 64 of the movable support 36 such that the movable support 36 can move along a straight line of travel (i.e., a straight path) between the operation and service positions. Preferably, there is a service position stop 76 operable to prevent the movement of the movable support 36 beyond the service position. The side wall 18 of the enclosure 12 adjacent the mounting portion 42 may serve as an operation position stop to limit movement of the movable support 36 in the opposite direction.

In the service position, the mounting portion 42 and/or the electronic component 38 mounted to the movable support 36 are substantially closer to the illumination axis 220 of the light fixture 10 than when in the operation position; meaning that the mounting portion 42 and/or the electronic component 38 are less than three-fourths or, more preferably, less than one-half of the distance from the illumination axis 220 as compared to their respective positions when the movable support 36 is in the operation position. For example, when the movable support 36 is in the service position, the mounting portion 42 and/or the electronic component 38 mounted to the movable support 36 are spaced preferably no less than 1 inch, and most preferably no less than 1.4 inches from the illumination axis 220 for a light fixture 10 having an illumination aperture 34 with a diameter of 3.5 inches (or 3.375 inches) or less.

Figure 14:
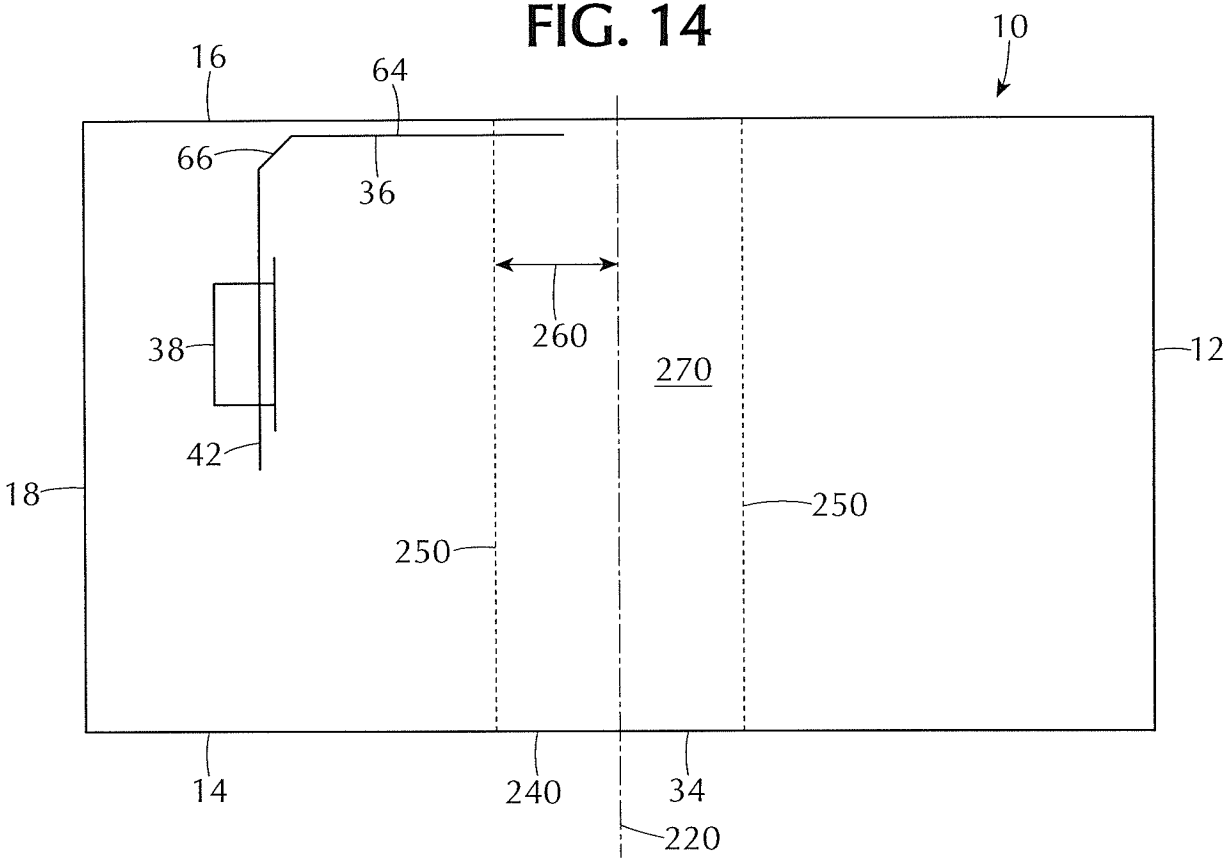
FIG. 14 is a cross-section, side elevation view of the light fixture, with the movable support intermediate the operation and service positions.

Referring to FIG. 14, preferably, when the movable support 36 is in the service position, the mounting portion 42 and/or the electronic component 38 mounted to the movable support 36 are at least partially disposed above the illumination aperture 34 to provide easy access to remove and replace the electronic component 38. More specifically, when the movable support 36 is in the service position, the mounting portion 42 and the electronic component 38 are spaced from the illumination axis 220 a distance less than a radius of the illumination aperture 34 (for a round aperture), or less than a minimum distance a periphery of the illumination aperture 34 and the illumination axis 220 (for round apertures or other apertures).

Additionally or alternatively, in the service position, the mounting portion 42 and/or the electronic component 38 mounted to the movable support 36 are preferably wholly or partially disposed within, or are closely adjacent to, a three dimensional service space 270 defined, at one end, by a plane 240 of the illumination aperture 34 and, at the other end, by the opposing portion of the enclosure 12, such as the back wall 16 of the enclosure 12. The service space 270 extends along the illumination axis 220 (centered in the illumination aperture 34) and has a cross-section (as taken perpendicular to the illumination axis 220) having or approximating the shape of the illumination aperture 34. For example, if as depicted, the illumination aperture 34 is substantially circular, then the service space 270 would have a substantially cylindrical shape and would have a substantially circular cross section (taken perpendicular to the illumination axis 220).

The service space 270 has an outer radial surface forming a radial boundary 250 of the service space 270 in all directions perpendicular to the illumination axis 220. If, as in the above example, the service space 270 is substantially cylindrical, then the radial boundary 250 of the service space 270 would be curved and would be spaced from the illumination axis 220 a constant distance equal to a radius of the illumination aperture 34, at all points around the periphery of the boundary. If the illumination aperture 34 has a square shape, then the radial boundary 250 would have four planar portions and would be spaced from the illumination aperture 34 at varying distances around the periphery of the boundary, ranging from a minimum of one-half of the width of the illumination aperture 34 to a maximum of one-half of the diagonal, corner-to-corner dimension of the illumination aperture 34.

When the movable support 36 is in the operation position, preferably no portion of the mounting portion 42 or the electronic component 38 mounted to the movable support 36 is within the service space 270, in other words, the mounting portion 42 and/or electronic component 38 are entirely outside of the service space 270, such that they do not interfere with the proper installation or operation of lighting element in the enclosure 12.

When the movable support 36 is in the service position, the mounting portion 42 and/or electronic component 38 are preferably disposed wholly or partially within the service space 270, but preferably no closer to the illumination axis 220 than a mid-point 260 between the radial boundary 250 of the service space 270 and the illumination axis 220 such that, when the movable support 36 is in the service position, a majority of the service space 270 is vacant to allow a person servicing the light fixture 10 to insert their hand through the illumination aperture 34 and into the enclosure 12. In particular, when the movable support 36 is in the service position, the mounting portion 42 and the electronic component 38 are spaced from the illumination axis 220 a distance no less than half a distance between the radial boundary 250 of the service space 270 and the illumination axis 220, as measured along a line passing through the illumination axis 220 and parallel to a line of travel of the movable portion.

It may also be preferable, especially in embodiments where the illumination aperture 34 is especially narrow, to have the mounting portion 42 adjacent to the service space 270 and not enter service space 270 in the service position. This would provide sufficient clearance for the wrist and palm, provide the fingers direct access to the mounting portion 42, and allow for the hand to naturally bend toward the mounting portion 42 for removal and installation of the electronic component 38.

The light fixture 10 includes means to selectively prevent or permit movement of the movable support 36 relative to the enclosure 12 and/or illumination aperture 34, which is preferably operable to fix the movable support 36 in the operation position or the service position, or any position therebetween. Such means can include an elongated slot 78 in the support portion 64 through which a locking fastener such as a locking screw 80 can be directed into a locking screw hole (not shown) in the back wall 16 of the enclosure 12. Thus, when the movable support 36 is in the operation position, the locking fastener 80 can be engaged (tightened) to prevent movement of the electronic component 38. The locking fastener 80 can be disengaged to allow the movable support 36 to move. Preferably, the locking fastener 80 need not be disconnected from the enclosure 12 to permit movement of the movable support 36. The means to selectively prevent or permit movement of the movable support 36 is preferably located within or closely adjacent the service space and its position are preferably fixed relative to the enclosure 12 and/or the illumination aperture 34. Alternatively, the locking fastener 80 or the means to selectively prevent or permit movement of the movable support 36 could move along with the movable support 36.

The service position stop 76 forms a limit to prevent the movable support 36 from moving closer to the illumination axis 220 than the service position, i.e., to prevent the movable support 36 from moving into the middle of the service space 270 thereby blocking entry into the enclosure 12 for service. The service position stop 76 can comprise the locking fastener 80 used to selectively permit and prevent movement of them movable support 36, in combination with the elongated slot 78 therefore in the support portion 64 of the movable support 36. In particular the location of the locking fastener 80 and the distance between the movable support 36 and the end of the slot adjacent the mounting portion 42 of the movable support 36 are preferably arranged such that the movable support 36 is in the service position when the locking fastener 80 contacts the end of the slot adjacent the mounting portion 42 of the movable support 36. The service position stop 76 therefore provides that the movable support 36 can be rapidly and conveniently moved into a desirable and consistent service position thereby promoting ease and efficiency in when servicing the fixture 10.

As can be appreciated, the position of the mounting portion 42 and/or electronic component 38 when the movable support 36 is in the service position allows visual and/or convenient access to the electronic component 38 and all mounting fasteners and connectors. The position also avoids the need to blindly reach to the wall of the enclosure 12 to remove and replace the electronic component 38 solely by feel. However, the movable support 36 and the electronic component 38 are positioned at least slightly off center in the illumination aperture 34 to allow a service person to insert their hand into the illumination aperture 34. Thus, the process of removing and replacing such components is greatly improved over prior light fixtures.

The mounting portion 42 can be substantially planar and the electronic component 38 can be mounted directly thereto or via a base plate 44 integral with or affixed to the electronic component 38. The mounting portion 42 has means to support the electronic component 38, which can include a mounting catch 46 and a mounting screw 48, operable to engage the base plate 44 of the electronic component 38. However, other suitable mounting structure or methods are within the scope of the invention.

The base plate 44 of the electronic component 38 has a mounting catch slot 50 sized and shaped to receive the mounting catch 46 of the mounting portion 42 and has a mounting fastener seat or mounting screw hole or slot 52 through which the mounting fastener such as a mounting screw can be directed to removably mount the electronic component 38 to the mounting portion 42 of the movable support 36.

To mount the electronic component 38 having a base plate 44 onto the mounting portion 42 of the movable support 36, the mounting catch slot 50 of the base plate 44 is aligned with and engaged to the mounting catch 46 and then the mounting fastener or mounting screw is directed through the base plate 44 into a threaded hole in the mounting portion 42. Dismounting the electronic component 38 from the mounting portion 42 is accomplished the reverse manner.

The base plate 44 can be substantially planar and may be removably affixed to the electronic component 38 with screws or other fasteners 54, or may be integrally formed with (and perhaps permanently affixed to) the electronic component 38. The base plate 44 is preferably rectangular in shape having a long axis and the base plate 44 and the electronic component 38 are sized and shaped such that the assembly thereof can be inserted into and removed from the enclosure 12 through the illumination aperture 34. Such removal and insertion may require that the assembly be orientated in a particular manner, such as with the long axis of the base plate 44 aligned perpendicular (or substantially perpendicular) to a plane 240 of the illumination aperture 34, or substantially parallel to the illumination axis 220 of the light fixture 10.

As depicted the mounting portion 42 of the movable support 36 can include an opening 56 sized and shaped to receive the electronic component 38, yet smaller than the base plate 44 such that that the assembly of the electronic component 38 and the base plate 44 can be mounted to the mounting portion 42 with base plate 44 abutting an interior surface 58 of the mounting portion 42 with the electronic component 38 extending through the opening in the mounting portion 42. The side wall 18 of the enclosure 12 which the mounting plate abuts when the movable support 36 is in the operation position preferably has an opening 60 sized and shaped to allow the electronic component 38 mounted on the mounting portion 42 to pass through when the movable support 36 is moved into the operation position, such that an exterior surface 62 of the mounting portion 42 abuts that wall.

A portion of electronic component 38 can be located outside of enclosure 12 in the operation position. In one embodiment, almost the entirety of electronic component 38 is outside of enclosure 12 in the operation position. This can lower the internal temperature of enclosure 12 and provide for more effective cooling of electronic component 38. Furthermore, this provides more space within enclosure 12 for other components.

The movable support 36 preferably includes a pushable portion 84 which provides a surface (or surfaces) to push or pull the movable portion into the desired position. As depicted, the pushable portion 84 can be formed by a flange depending perpendicularly from the support portion 64 along an edge opposite the mounting portion 42. When the movable support 36 is in the operation position, at least a part of the pushable portion 84 is preferably located within or closely adjacent the service space 270 to provide convenient access thereto. Also, the pushable portion 84 is preferably disposed at or closely adjacent a plane of the support portion 64 (or the plane of the sliding connection between the movable support 36 and the enclosure 12) such that when a force is applied thereto, little or no rotational moment is created in the movable support 36, which could cause the sliding attachment to bind.

As depicted, the height of the pushable portion 84 is a small fraction (e.g. about $1/10^{th}$) of the width of the support portion 64 as measured from the pushable portion 84 to the mounting portion 42. This provides sufficient surface area for pushing while avoiding binding.

The electronic component 38 mounted to the movable support 36 may typically have a first set of wires 90 connected to a power source (or power source electronic components after the power source) and a second set of wires 92 connected to lighting element (or another electronic component before lighting element). Such wires can be terminated with plastic, modular connectors 94, 96 which mate with complimentary modular connectors of the connected component. It is desirable that the modular connectors 94, 96 be fixed relative to the enclosure 12 and/or illumination aperture 34 during operation of the lighting fixture 10 and also that the modular connectors 94, 96 be covered during operation.

To remove and replace the electric component mounted to the movable support 36, it is necessary to disconnect and reconnect the modular connectors 94, 96. The lighting fixture 10 provides that the modular connectors 94, 96 are easily accessible when the movable support 36 is in the service position.

The modular connectors 94, 96 are removably fixed to the movable support 36 in a position such that the modular connectors 94, 96 are within or closely adjacent the service space 270 when the movable support 36 is in the service position. Preferably, the modular connectors 94, 96 are removably fixed to the support portion 64 intermediate the mounting portion 42 and the pushable portion 84 (and on either side of the locking screw slot) such that the modular connections are readily accessible when the movable support 36 is in the service position.

The lighting fixture 10 includes two modular connector covers 98, 100. Each modular connector is removably attached to an associated modular connector cover. Each modular connector cover may be formed from sheet metal, or the like, in a step-shape, with a base portion 102, a riser portion 104 and a land portion 106. The base portion 102 of each modular connector cover is removably attachable to the support portion 64 of the movable support 36. The land portion 106 of each cover is connected to the base portion 102 by the riser portion 104. The base portion 102 and land portion 106 are substantially parallel to each other, with the riser portion 104 being perpendicular thereto. The modular connector attached to the land portion 106 is disposed intermediate the land portion 106 and the support portion 64. Thus the land portion 106 substantially covers the modular connector. The complimentary modular connector need not be (but could be) connected to the land portion 106 also. The base portion 102 of the cover can be connected to the support portion 64 by any suitable means that allows selective attachment thereto. For example, the base portion 102 can include a mounting hole or slot 108 operable to receive a threaded fastener (screw) 110 extending from the support portion 64, and a wing nut 112 or the like can be used to selectively clamp the base portion 102 to the support portion 64.

The support portion 64 can include a pair of alignment guides 114, 116 to ensure proper alignment of the each modular connector cover during installation.

Other means to move the movable support 36 between the operation and service positions are within the scope of the invention. For example, the movable support 36 can be slidably connected to the side walls of the enclosure 12 and/or the front wall 14, or the movable support 36 could be rotationally connected to the enclosure 12 such that it can move between the operation and service positions. Another suitable alternative would be a linkage connection between the movable support 36 and the enclosure 12. As can be appreciated there are a number of means within the contemplation of the invention that would be suitable for allowing controlled, selective movement of the movable support 36 between the operation and service positions. Thus, the path or line of travel of the movable support 36 between the operation and service position need not be a straight line. In certain circumstances, the movable support 36 could follow a curved line or a complex or varying path.

The process of removing and replacing an electronic component 38 with the disclosed lighting fixture 10 can be accomplished with one hand, inserted through the illumination aperture 34 by: disengaging the locking fastener 80 of the movable support 36 and moving the movable support 36 from the operation position to service position; disconnecting the electrical connections of the electronic component 38 mounted to the mounting portion 42; dismounting the electronic component 38 from the movable support 36; removing the electronic component 38 from the enclosure 12 through the illumination aperture 34; after removal, inserting another electronic component 38 through the illumination aperture 34; mounting the other electronic component 38 to the movable support 36; connecting the electrical connections of the other electronic component 38; moving the movable support 36 from the service position back to the operation position; and engaging the locking fastener 80 of the movable support 36 to fix the movable support 36 in the operation position.

Prior to the step of removing the electronic component 38, it is necessary to remove lighting element from the enclosure 12 and disconnect the electrical connections of lighting element from the electronic component 38; and after installing the other electronic component 38, it is of course necessary to again connect the electrical connections of the other electronic component 38 to lighting element and then to re-install lighting element into the enclosure 12.

Figure 15:
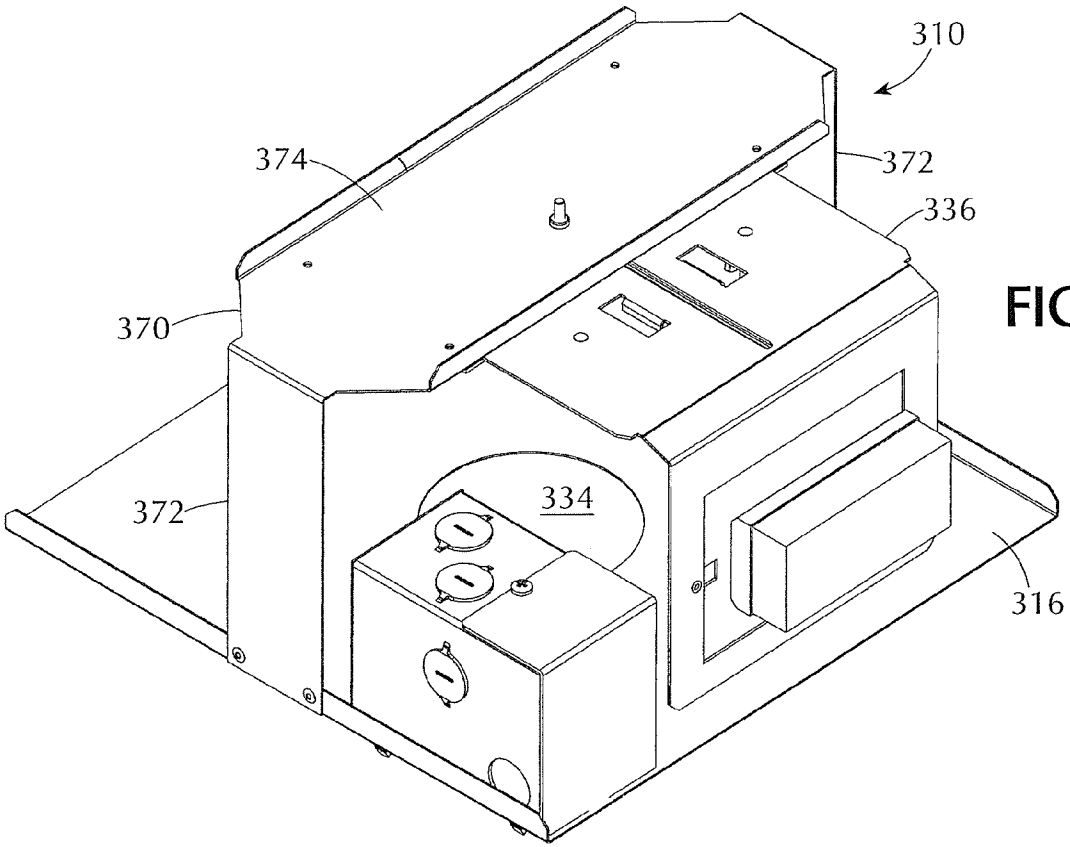
FIG. 15 is a perspective view of an alternative embodiment of the light fixture showing the movable support in the operation position.
Figure 16:
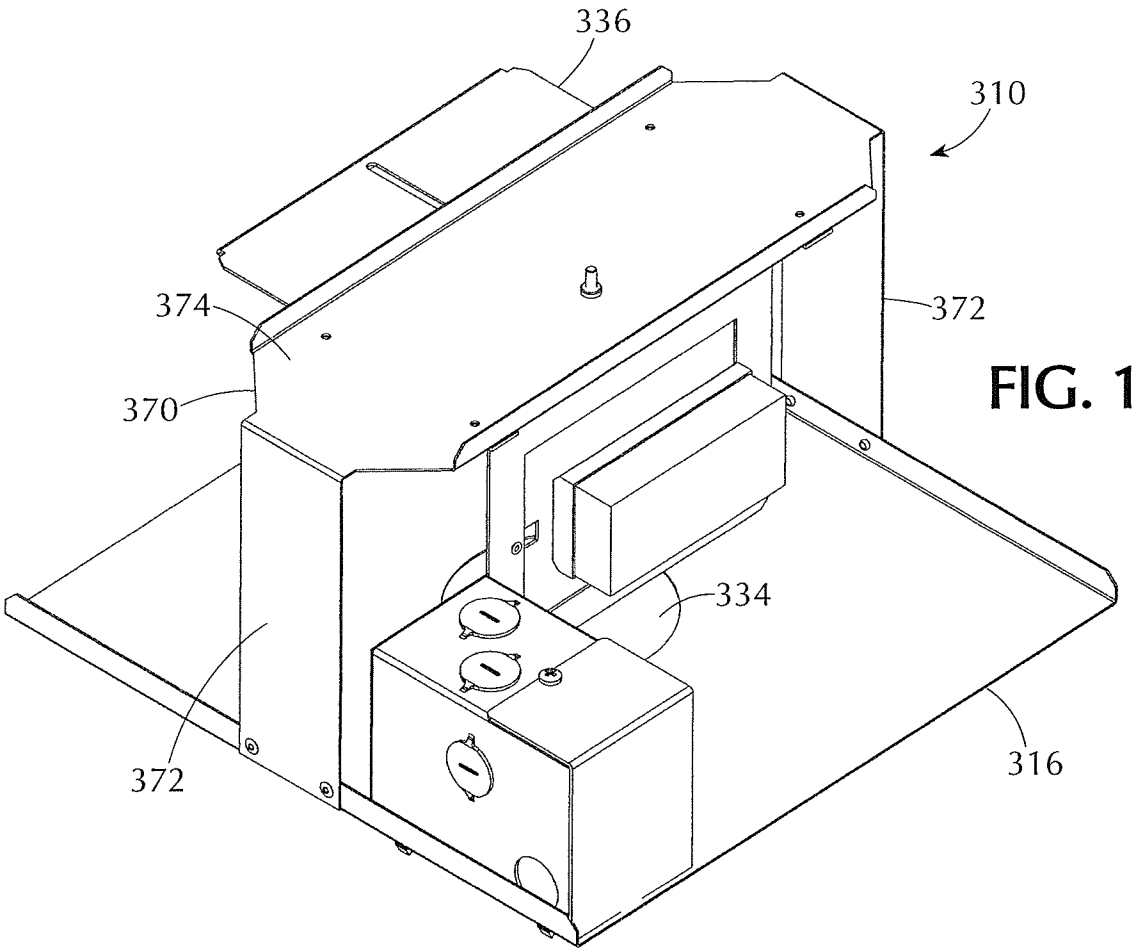
FIG. 16 is a perspective view of the light fixture of FIG. 15, showing the movable support in the service position.

Referring to FIGS. 15 and 16, the light fixture 310 can be in the form of a "plaster frame" or "rough-in" frame, having a mostly open structure, with no complete or partially complete enclosure around the movable support. For example, as depicted, the light fixture 310 can have a single wall 316 with the illumination aperture 334 therein, with no side walls or back wall (or no complete or substantial side or back walls). In this embodiment, the movable support 336 can be movably coupled to the light fixture 310 by a bridge 370 which is fixedly connected to the wall 316 and/or fixed relative to the illumination aperture 334. The bridge 370 has a pair of leg portions 372 fixedly connected to the wall 316 at their lower ends on either side of the illumination aperture 334. A span portion 374 of the bridge spans between upper ends of the leg portions 372 and is disposed above the illumination aperture 334. The span portion 374 is fixed relative to the wall 316 and/or relative to the illumination aperture 334 and partially defines a boundary of the service space of the light fixture. The span portion 374 is spaced a distance from the wall 316 a distance sufficient to permit the insertion and proper installation of a light (not shown) through the illumination aperture 334. The movable support 336 is movably coupled to the span portion 374 preferably in a manner similar to the manner in which the movable support is coupled to the back wall of the enclosure of the embodiments described above. The other features and functions of the light fixture 310 can be similar or identical to the corresponding features and functions of the embodiments described above. For example, FIG. 15 depicts the movable support 336 in the operation position and FIG. 16 depicts the movable support 336 in the service position.

Alternatively, the movable support 336 can be movably coupled directly to structure forming the illumination aperture 334, for example wall 316. For this purpose, the movable support 336 can include a pair of leg portions (not shown) which are fixed relative to the movable support and which are movably coupled to the wall 316 (or other structure forming or fixed relative to the illumination aperture), such as on either side of the illumination aperture, to permit the movable support to move relative to the illumination aperture. The other features and functions of this alternative embodiment can be the same or similar to the embodiments described above.

In all embodiments, the illumination aperture 334 has a room-facing side and a support structure facing side, opposite the room-facing side. In use, the room-facing side of the illumination aperture 334 faces the room or space into which light is being projected by the light fixture. The support structure facing side of the illumination aperture 334 faces toward the interior of the wall or ceiling, or other support structure of the room or building into or on which the light fixture is installed. As can be appreciated, if the light fixture includes an enclosure, then the support structure facing side of the illumination aperture 334 also faces into the interior of such enclosure.

The illumination axis passes through a center of the illumination aperture perpendicular to a plane of the illumination aperture and extends on both the room-facing side and the support structure facing side of the illumination aperture.

The service space of the light fixture is on the support structure facing side of the aperture. For example, if the light fixture has an enclosure, then the interior of the enclosure is on the support structure facing side of the illumination aperture and the service space is thus within the interior of the enclosure.

The movable support is movably coupled to a fixed portion of the light fixture that is fixed relative to the illumination aperture. As described above, that fixed portion can be a (fixed) back wall of an enclosure or a (fixed) bridge, or some other structure fixed relative to enclosure and/or the illumination aperture.

Although the invention has been described with reference to a particular arrangement of parts, features and the like, these are not intended to exhaust all possible arrangements or features, and indeed many modifications and variations will be ascertainable to those of skill in the art. For example, and without limitation, a light fixture constructed in accordance with the invention may be a recessed light fixture, where the fixture (or a majority thereof) is disposed within an external support structure, such as a ceiling or wall, or may be a surface mount fixture, where the fixture (or a majority) is disposed on or outside of the ceiling or wall. It can be appreciated that other variations of the placement and configuration of the light fixture are contemplated by the invention.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A light fixture, comprising:

an enclosure;

an illumination aperture in the enclosure, the illumination aperture having a room-facing side and an enclosure facing side opposite the room-facing side;

an illumination axis passing through a center of the illumination aperture perpendicular to a plane of the illumination aperture;

a service space within the enclosure, the service space having a cross-section corresponding to a shape of the illumination aperture and extending along the illumination axis from the illumination aperture into the enclosure;

a movable support movably connected to the enclosure, the movable support having a support portion movably engaged with the enclosure and having a mounting portion connected to the support portion;

the movable support being movable between an operation position and a service position;

in the operation position, the mounting portion abutting an interior surface of a side wall of the enclosure which serves as an operation position limit stop of the movable support;

in the service position, the mounting portion being spaced from the interior surface of the side wall of enclosure;

an electronic component removably mounted to the mounting portion of the movable support;

the mounting portion of the movable support having an opening sized and shaped to receive the electronic component, and the electronic component extending through the opening in the mounting portion;

the side wall of the enclosure having an opening sized and shaped to receive the electronic component, and, in the operation position, the electronic component extending through the opening in the side wall of the enclosure; and the electronic component being located outside of the service space in the operation position, and the electronic component being partially or wholly within the service space in the service position.

2. The light fixture of claim 1, wherein the movable support moves along a line of travel between the operation position and the service position, and in the service position, the electronic component is spaced from the illumination axis a distance no less than half a distance between a radial boundary of the service space and the illumination axis, as measured along a line passing through the illumination axis and parallel to the line of travel of the movable support.

3. The light fixture of claim 1, wherein, the illumination aperture has a radius of no greater than 4 inches, and in the service position, the electronic component is spaced from the illumination axis a distance no less than 1.4 inches.

4. The light fixture of claim 1, further comprising a service position stop operable to limit a movement of the movable support toward the illumination axis at the service position.

5. The light fixture of claim 4, further comprising:

means to selectively permit and prevent movement of the movable support relative to the illumination aperture, and the means to selectively permit and prevent movement of the movable support comprises the service position stop.

6. The light fixture of claim 5, wherein:

the means to selectively permit and prevent movement of the movable support comprises a locking fastener directed through a slot in the movable support and into locking fastener receiving structure of the light fixture, and the locking fastener is disposed within the service space, wherein selective engagement of the locking fastener operates to prevent movement of the movable support relative to the illumination aperture, and wherein the locking fastener contacts an end of the slot in the service position.

7. The light fixture of claim 6, wherein:

the movable support moves along a line of travel between the operation position and the service position, and in the service position, the electronic component is spaced from the illumination axis a distance no less than half a distance between a radial boundary of the service space and the illumination axis, as measured along a line passing through the illumination axis and parallel to the line of travel of the movable support.

8. The light fixture of claim 1, wherein the movable support comprises a pushable portion disposed wholly or partially within the service space in the operation position.

9. The light fixture of claim 1, further comprising:

the movable support has a mounting portion;

the electronic component being removably mounted to the mounting portion; and the electronic component includes a base plate;

wherein the base plate couples the electronic component to the movable support by engaging the mounting portion.

10. The light fixture of claim 9, further comprising:

a mounting fastener and mounting catch coupled to the mounting portion;

a mounting catch slot and a mounting fastener seat on the base plate; and the mounting catch slot being operable to engage the mounting catch and the mounting fastener being operable to engage the mounting fastener seat to couple the electronic component to the mounting support.

11. The light fixture of claim 1, further comprising:

a locking fastener; and the locking fastener has an engaged state wherein it prevents movement of the movable support relative to the illumination aperture and has a disengaged state wherein it permits movement of the movable support relative to the illumination aperture.

12. The light fixture of claim 1, further comprising:

a wire and a modular connector electrically coupled to the wire;

a modular connector cover coupled to the modular connector; and the modular connector cover being coupled to the movable support by a removable fastener.

13. The light fixture of claim 1, further comprising:

at least one exterior mount that mounts the light fixture to a support structure.

14. The light fixture of claim 1, further comprising:

one or more rails that movably couple the movable support to the light fixture;

wherein the movable support slides along the one or more rails between the operation position and the service position.

15. The light fixture of claim 14, wherein the light fixture comprises a back wall on the enclosure facing side of the illumination aperture and the rails are mounted to the back wall on either side of the service space.

16. The lighting fixture of claim 1, further comprising:

the electronic component being located a first distance from the illumination axis in the operation position and the electronic component being located a second distance from the illumination axis in the service position, and the second distance being less than one-half of the first distance.

17. The light fixture of claim 16, wherein the second distance is less than a radius of the illumination aperture.

18. The light fixture of claim 16, wherein the first distance is greater than twice the radius of the illumination aperture.

* * * * *